US008955321B2

(12) United States Patent
Berke et al.

(10) Patent No.: US 8,955,321 B2
(45) Date of Patent: Feb. 17, 2015

(54) METHOD FOR PRIMARY CONTROL OF A STEAM TURBINE INSTALLATION

(75) Inventors: Olaf Berke, Mannheim (DE); Franz-Josef Höly, Hemsbach (DE); Karsten Müller, Viernheim (DE); Reinhard Johannes Severin Cloppenburg, Hirschberg-Leutershausen (DE)

(73) Assignee: Alstom Technology Ltd., Baden (CH)

( * ) Notice: Subject to any disclaimer, the term of this patent is extended or adjusted under 35 U.S.C. 154(b) by 478 days.

(21) Appl. No.: 12/781,593

(22) Filed: May 17, 2010

(65) Prior Publication Data

US 2010/0293948 A1 Nov. 25, 2010

(30) Foreign Application Priority Data

May 19, 2009 (DE) ..... 10 2009 021 924

(51) Int. Cl.
*F01K 13/00* (2006.01)
*F01K 13/02* (2006.01)

(52) U.S. Cl.
CPC ..... *F01K 13/02* (2013.01)
USPC ..... 60/645

(58) Field of Classification Search
CPC ..... F01K 13/02; F01K 23/108; F01K 3/04; F01K 7/24
USPC ..... 60/645, 646, 663, 686, 707, 616, 618, 60/677
See application file for complete search history.

(56) References Cited

U.S. PATENT DOCUMENTS 3,931,500 A * 1/1976 Berkebile et al. ..... 376/217
4,004,424 A * 1/1977 Maddagiri ..... 60/646
4,389,847 A * 6/1983 Kehlhofer ..... 60/659
4,428,190 A * 1/1984 Bronicki ..... 60/655

(Continued)

FOREIGN PATENT DOCUMENTS

CN 101260815 A 9/2008
DE 3304292 A1 4/1984

(Continued)

OTHER PUBLICATIONS

Chinese Office Action dated Dec. 3, 2013, issued by the State Intellectual Property Office of People's Republic of China in corresponding Chinese Patent Application No. 201010189960.9. (8 pages).

*Primary Examiner* — Thomas Denion
*Assistant Examiner* — Jason Shanske
(74) *Attorney, Agent, or Firm* — Buchanan Ingersoll & Rooney PC

(57) ABSTRACT

A method is provided for primary control of a steam turbine installation in network operation, which provides at least two pressure stages, these being a high-pressure and a low-pressure steam turbine stage, in which for storing reserve power a live steam valve along an operating-steam feed line to at least one pressure stage of the steam turbine is operated in a throttled manner, the live steam valve, in the case of a reducing network frequency and network frequency boosting which is necessary as a result of this, is transferred to an at least less throttled state. At least some of the partially expanded operating steam which issues from the high-pressure steam turbine stage is introduced directly without reheating, into the low-pressure steam turbine stage for further expansion.

3 Claims, 1 Drawing Sheet

(56) References Cited

U.S. PATENT DOCUMENTS

| | | | | |
|---|---|---|---|---|
| 4,448,026 | A | 5/1984 | Binstock et al. | |
| 4,455,836 | A * | 6/1984 | Binstock et al. | 60/663 |
| 4,471,620 | A * | 9/1984 | Binstock et al. | 60/653 |
| 4,598,551 | A * | 7/1986 | Dimitroff et al. | 60/646 |
| 6,223,518 | B1 | 5/2001 | Wada et al. | |
| 6,405,537 | B1 * | 6/2002 | Wada et al. | 60/778 |
| 2003/0167774 | A1 * | 9/2003 | Bescherer et al. | 60/772 |
| 2009/0292436 | A1 * | 11/2009 | D'Amato et al. | 701/100 |

FOREIGN PATENT DOCUMENTS

| | | | |
|---|---|---|---|
| DE | 19750125 | A1 | 3/1999 |
| DE | 102008029941 | A1 | 5/2009 |
| EP | 1854964 | A1 | 11/2007 |
| GB | 2131929 | A | 6/1984 |
| JP | 3694530 | B2 | 9/2005 |

* cited by examiner

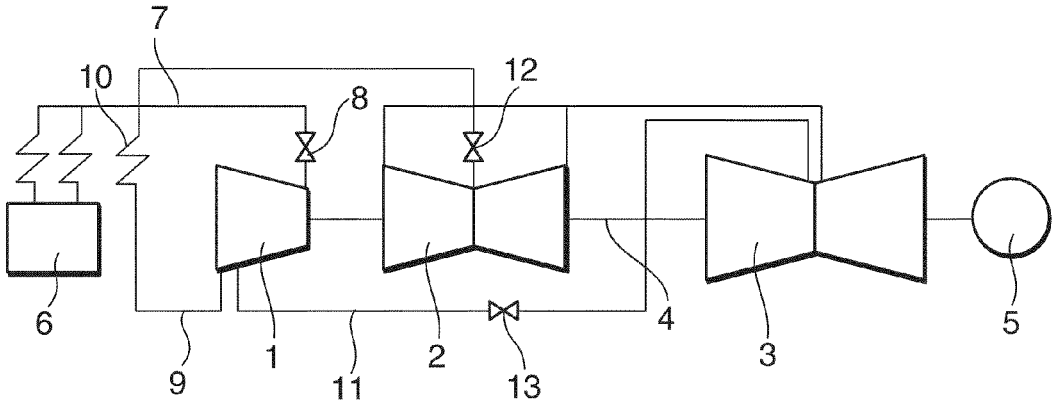
7
10
12
8
6
9
1
11
2
13
4
3
5

METHOD FOR PRIMARY CONTROL OF A STEAM TURBINE INSTALLATION

FIELD OF INVENTION

The invention relates to a method for primary control of a steam turbine installation in network operation, which provides at least two pressure stages, these being a high-pressure and a low-pressure steam turbine stage, in which for storing reserve power a live steam valve along an operating steam feed line to at least one pressure stage of the steam turbine is operated in a throttled manner, which live steam valve, in the case of a decreasing network frequency and network frequency boosting which is required as a result of this, is transferred to an at least less throttled state.

BACKGROUND

The power plants which are connected to the supply network for feeding electric power are subjected to specific requirements for a trouble-free operation. This especially concerns the so-called primary control within the network, according to which power reserves have to be generated and fed to the network within a matter of seconds by means of the associated power plants for restoring normal operation in the event of a fault which is characterized, for example, by a drop in power and a drop in frequency which is associated therewith. Thus, on the part of the power plants it is necessary, for example, to additionally activate at least two percent of the respective power plant nominal output for primary control within a time span of 30 seconds at most.

In the case of steam power plants, it is customary to keep the inlet valves for respective steam-turbine stages in a throttled position for this purpose, in order to be able to utilize the steam reserve of the steam generator by means of spontaneous opening of the inlet valves during briefly occurring frequency deviations. In this way, it is possible to release stored power reserves and therefore counteract the frequency deviation within the network.

In addition to increasing power by means of increasing or decreasing the throttling of control valves, it is also known to shut down preheaters which are provided in the water-steam cycle of the steam turbine and are heated by means of bleed steam from the steam turbine. A stream of condensate which is directed through the low-pressure preheaters at the same time can be stopped within a few seconds and increased again. This measure for fast power control in fossil-fired power plant units by means of directed shutting down of the preheaters with condensate stopping is described, for example, in DE 33 04 292 C2.

SUMMARY

The disclosure is directed to a method for primary control of a steam turbine installation in network operation. The installation includes at least a high-pressure and a low-pressure steam turbine stage. For storing reserve power, a live steam valve along an operating-steam feed line to at least one pressure stage of the steam turbine, is operated in a throttled manner. The live steam valve is transferred to a less throttled state in the event of a reducing network frequency, thereby necessitating network frequency boosting. The method includes introducing at least some partially expanded operating steam which issues from the high-pressure steam turbine stage directly, without reheating, into the low-pressure steam turbine stage for further expansion.

BRIEF DESCRIPTION OF THE DRAWING

The method according to the solution shall subsequently be explained in more detail based on a three-stage steam turbine arrangement with reference to the single drawing.

FIG. 1 shows a schematized layout of a steam turbine installation comprising a high-pressure turbine stage 1, an intermediate-pressure turbine stage 2, and also a low-pressure turbine stage 3. All the turbine stages are arranged along a common shaft 4 for driving a generator 5.

DETAILED DESCRIPTION OF THE PREFERRED EMBODIMENTS

INTRODUCTION TO THE EMBODIMENTS

The invention is based on the object of developing a method for fast power control of a steam turbine installation in network operation, which provides at least two pressure stages, these being a high-pressure and a low-pressure steam turbine stage, in such a way that, with particularly low cost, a reliable and fast power control is ensured.

The achieving of this object is disclosed in claim 1. Features which advantageously develop the inventive idea are the subject of the dependent claims and are to be gathered from the further description with reference to the exemplary embodiment.

According to the solution, a method for primary control of a steam turbine installation in network operation is disclosed where at least some of the partially expanded operating steam which issues from the high-pressure steam turbine stage is introduced directly, that is to say without reheating, into the low-pressure steam turbine stage for further expansion.

In contrast to customary operating methods of steam turbine installations, in which the partially expanded operating steam which issues from the high-pressure steam turbine stage is fed to a reheater unit in order to be fed as reheated, partially expanded steam to the low-pressure steam turbine stage or to an intermediate-pressure steam turbine stage which is connected upstream to the low-pressure steam turbine stage, the concept according to the solution makes provision for a directed bypassing of the reheater unit. As a result of this, a time delay, which is associated with reheating, in transmitting the partially expanded operating steam from the high-pressure steam turbine stage to the subsequent steam turbine stage which in each case is operated at a lower pressure level, is advantageously avoided so that in the case of a necessary network frequency boost the additional operating steam, which is released into the high-pressure steam turbine stage as a result of reducing the throttling of the operating steam, can be fed directly, immediately and without time delay after discharging from the high-pressure steam turbine stage into the subsequent steam turbine stage which is operated at a lower operating pressure, so that with a far shorter reaction capability compared with previous conventional operating methods additional steam, and therefore additional power which is associated therewith, can be made available for network frequency boosting.

Thus, the reaction time of previous network-frequency boosting measures for the spontaneous call-off of reserve power is customarily between 3 and 30 seconds, this relating to the aforesaid techniques of condensate stopping associated with bleed steam stopping and also with the throttling of steam valves for storing reserve power. With the measure according to the solution, the entire stored reserve power can be completely called off via the high-pressure and low-pressure steam turbine stages inside of 3 to 10 seconds. As a result of the immediate power call-off, spontaneously occurring destabilizations of the network frequency can be counteracted with far better efficiency than is the case with previous network-frequency boosting.

DETAILED DESCRIPTION

During normal operation, the high-pressure steam turbine 1 is fed with operating steam from a steam boiler with superheater 6, wherein the heated operating steam reaches the high-pressure steam turbine 1 via a steam feed line 7 with a live steam valve 8.

Via a secondary steam line 9, the operating steam which issues in a partially expanded state from the high-pressure steam turbine 1 reaches a reheater unit 10 in which the partially expanded operating steam is heated and transferred to the intermediate-pressure steam turbine 2 for further partial expansion. Finally, the partially expanded steam which issues from the intermediate steam turbine 2 reaches the low-pressure steam turbine 3.

For storing reserve power, the live steam valve 8 is throttled in an as-known per se manner so that an increased pressure level is established upstream along the steam feed line 7. If a network frequency fault in the sense of a non-tolerable frequency deviation from the nominal frequency, for example 50 Hz, is determined, then in the case of a determined underfrequency the throttling of the live steam valve 8 is reduced right through to a complete opening so that the stored power reserve in the form of a spontaneously increased volume of steam can be fed to the high-pressure steam turbine stage 1. In this case, the partially expanded volume of steam which issues from the high-pressure steam turbine stage 1 is partially, but preferably completely, directed into the low-pressure steam turbine stage 3 without reheating by opening a valve unit 13 along the steam feed line 11. The valve unit 13 is opened exclusively in the event of network frequency boosting. On account of the direct steam feed between high-pressure steam turbine stage 1 and low-pressure steam turbine stage 3, the shaft 4 is driven by the high-pressure and low-pressure steam turbine stages 1, 3, largely without time delay, which is attributable to the exclusion of the reheater unit 10, so that a spontaneous power increase of up to 10% can be tapped off at the generator 5 for the purpose of frequency boosting.

If, on the other hand, a network fault in the sense of an over-frequency occurs, then this fault can be conventionally countered in an as-known per se manner by a power reduction of the steam turbine installation.

LIST OF DESIGNATIONS

1 High-pressure steam turbine stage
2 Intermediate-pressure steam turbine stage
3 Low-pressure steam turbine stage
4 Shaft
5 Generator
6 Steam generator with superheater
7 Steam feed line
8 Live steam valve
9 Steam line
10 Reheater unit
11 Steam feed line
12 Reheat valve
13 Valve unit

What is claimed is:

1. A method for primary control of a steam turbine installation in network operation, the steam turbine installation including at least a high-pressure and a low-pressure steam turbine stage, the method comprising:

operating a live steam valve, along an operating-steam feed line to at least one pressure stage of the steam turbine, in a throttled manner for storing reserve power;

introducing at least some partially expanded operating steam which issues from the high-pressure steam turbine stage into the low-pressure steam turbine stage via a direct steam feed line between the high-pressure steam turbine stage and the low-pressure steam turbine stage for further expansion, in the event of reduced network frequency and the live steam valve being transferred to a less throttled state, for network frequency boosting, wherein the at least some partially expanded operating steam which issues from the high-pressure steam turbine that is introduced into the low-pressure steam turbine via the direct steam feed line is not reheated.

2. The method as claimed in claim 1, wherein in the operation of the throttled live steam valve for storing reserve power, operating steam which issues in a partially expanded state from the high-pressure steam turbine stage is directed via a reheater unit for maintaining a reheated, partially expanded operating steam which is fed to an intermediate-pressure steam turbine unit and to a low-pressure steam turbine stage which is connected thereto, and in the case of network frequency boosting at least some of the operating steam which issues in a partially expanded state from the high-pressure steam turbine stage is directed to the low-pressure steam turbine stage via the direct steam feed line.

3. The method as claimed in claim 2, wherein the steam turbine installation further comprises a valve unit, along the direct steam feed line, which is opened exclusively in the event of network frequency boosting.

* * * * *